US005690862A

United States Patent [19]

Moore, Jr. et al.

[11] Patent Number: 5,690,862

[45] Date of Patent: Nov. 25, 1997

[54] NO FLASH POINT SOLVENT SYSTEM CONTAINING NORMAL PROPYL BROMIDE

[75] Inventors: Robert M. Moore, Jr.; Robert L. Davis; William E. Moehle; Burnell Lee; Edgar E. Spielman, Jr., all of Baton Rouge, La.

[73] Assignee: Albemarle Corporation, Richmond, Va.

[21] Appl. No.: 551,641

[22] Filed: Nov. 1, 1995

[51] Int. Cl.[6] ..... C11D 7/24; C11D 7/30; C11D 7/50; C23G 5/028

[52] U.S. Cl. ..... 252/364; 510/245; 510/258; 510/264; 510/267; 510/273; 134/40

[58] Field of Search ..... 252/364; 134/40; 510/245, 258, 264, 267, 273

[56] References Cited

U.S. PATENT DOCUMENTS

| | | | |
|---|---|---|---|
| 2,371,645 | 3/1945 | Aitchison et al. | 134/31 |
| 3,730,904 | 5/1973 | Clementson et al. | 134/28 |
| 3,773,677 | 11/1973 | Boyles | 510/170 |
| 3,922,316 | 11/1975 | Versnel et al. | 570/215 |
| 4,056,403 | 11/1977 | Cramer et al. | 134/22.19 |
| 4,107,077 | 8/1978 | Sullivan, Jr. et al. | 435/18 |
| 4,377,533 | 3/1983 | Bouisset et al. | 558/369 |
| 4,652,389 | 3/1987 | Moll | 510/279 |
| 4,900,456 | 2/1990 | Ogilvy | 507/269 |
| 5,102,573 | 4/1992 | Han et al. | 134/19 |
| 5,190,678 | 3/1993 | Swartz et al. | 508/393 |
| 5,207,953 | 5/1993 | Thorssen et al. | 252/601 |
| 5,320,683 | 6/1994 | Samejima et al. | 134/40 |
| 5,403,507 | 4/1995 | Henry | 510/365 |
| 5,414,142 | 5/1995 | Chapman et al. | 568/579 |
| 5,492,645 | 2/1996 | Oshima et al. | 510/412 |
| 5,616,549 | 4/1997 | Clark | 510/412 |

FOREIGN PATENT DOCUMENTS

| | | |
|---|---|---|
| 0609004 | 8/1994 | European Pat. Off. . |
| 6128591 | 5/1994 | Japan . |
| 7150197 | 6/1995 | Japan . |

OTHER PUBLICATIONS

Fessenden, Ralph et al., "Organic Chemistry", Boston, MA., Willard Grant Press. (1982), 2nd Ed., p. 81.

Sax, Irving et al., "Hawley's Condensed Chemical Dictionary", New York, Van Nostrand Reinhold Company. (1987). 11th Ed., pp. 613–614.

Kirk–Othmer Encyclopedia of Chemical Technology, "Blood, Coagulants and Anticoagulants to Cardiovascular Agents", Third Edition, vol. 4, (1978), John Wiley & Sons, Inc., New York, pp. 256, 257, 262.

NFPA 325—National Fire Protection Association, Inc., *Guide to Fire Hazard Properties of Flammable Liquids, Gases, and Volatile Solids,* 1994 Edition, prepared by the Technical Commitee on Classification and Properties of Hazardous Chemical Data, pp. 325–1–325–94.

Abstract—Japanese Patent No. 03173835–A published Jul. 29, 1991, assigned to Asahi Glass, entitled "New stabilising (pseudo) azeotropic tri: coloro: di: fluoroethane composition useful as substitute freon and for heat transfer medium, foaming agent and precision instrument parts".

*Primary Examiner*—Joseph D. Anthony

*Attorney, Agent, or Firm*—Edgar E. Spielman, Jr.

[57] ABSTRACT

This invention relates to a solvent system which is non-flammable and which is comprised of a hydrocarbon solvent having a flash point less than about 38° C. and a second solvent containing at least 90 wt % n-propyl bromide, the second solvent being present in an amount sufficient to obtain no flash point for the solvent system when tested in accordance with ASTM D-93 and the second solvent being the sole halogenated solvent and flash point suppressor in the solvent system.

16 Claims, No Drawings

NO FLASH POINT SOLVENT SYSTEM CONTAINING NORMAL PROPYL BROMIDE

BACKGROUND OF THE INVENTION

This invention relates to economical n-propyl bromide-based solvent systems which have no flash point. The solvent systems may be used in non-classified locations in accordance with the criteria of the National Electrical Code®, Article 500 of NFPA 70.

n-Propyl bromide has long been recognized as a solvent suitable for degreasing and cleaning metal and plastic articles. See *Kirk-Othmer Encyclopedia of Chemical Technology*, 3rd Edition, Vol. 4, Page 257, John Wiley & Sons Inc., 1978. Also, see European Patent Application No. 0 609 004 A1 which discloses the use of n-propyl bromide as a deterging solvent suitable for use in metal degreasing applications. The '004 application additionally notes that brominated hydrocarbons, e.g., n-propyl bromide, are inferior to chlorofluorocarbons and chlorocarbons with respect to chemical stability and flammability. The chemical instability can be attenuated, according to the '004 application, by combining certain stabilizers with the brominated hydrocarbons in an amount which is in excess of 0.1 wt % based upon the total weight of the brominated hydrocarbon present.

The question of flammability is more problematic. Much of the published art teaches that n-propyl bromide has a relatively high susceptibility to ignition and burning. (According to the National Fire Protection Association, Inc. in NFPA 325, "Guide to Fire Hazard Properties of Flammable Liquids, Gases, and Volatile Solids", 1994 Edition, n-propyl bromide has the high Flammability Hazard Rating of 3.) On the other hand, it has also been taught by others that n-propyl bromide does not have a flash point. (See the product brochure for SC-52A by Dipsol Chemical Co., Ltd.) A lack of a flash point argues well that n-propyl bromide is not flammable.

In addition to the questions concerning its flammability and its need for stabilizers, n-propyl bromide is not necessarily the lowest cost solvent available. However, its environmental advantages, e.g., ozone depletion potential and global warming potential, are significant. Thus, there is a need for designing a n-propyl bromide containing solvent which has reduced stabilizer requirements, no flash point and which is still able to avail itself of the advantages of n-propyl bromide, all without increased costs.

THE INVENTION

This invention relates to a solvent system which is comprised of:

(a) as a first solvent, at least about 10 vol % of a hydrocarbon solvent having a flash point which is below about 38° C.; and (b) a second solvent which consists essentially of at least about 90 wt % n-propyl bromide and less than 10 to 0 wt % other brominated propane(s), based upon the total weight of the second solvent, the second solvent, (1) being present in an amount which is, (i) at least about 10 vol % of the total solvent system, and (ii) is sufficient to obtain no flash point for the solvent system when tested in accordance with ASTM D-93; and (2) being the sole halogenated solvent and flash point suppressor constituent in the solvent system.

This invention also relates to the use of such solvent systems in a non-classified location in accordance with Article 500 of NFPA 70, National Electrical Code. This code designates as hazardous (classified) any location in which a combustible material is or may be present in the atmosphere in sufficient concentration to produce an ignitable mixture. The intent of Article 500 is that electrical equipment and systems in hazardous (classified) locations should not provide a means of ignition for an ignitable mixture that may be present. The designation of "non-classified" is reserved for when "Experience has shown that the release of ignitable mixtures from some operations and apparatus is so infrequent that area classification is not necessary". The solvent systems of this invention do not form ignitable mixtures as is evident from their not having a flash point. Thus, they are not required to be used in classified locations which meet the special NFPA criteria.

n-Propyl bromide has an atmospheric, sea-level boiling point of about 71° C. As mentioned previously, n-propyl bromide has been variously reported to be non-flammable or to have the high NFPA Flammability Hazard Rating of 3. The Flammability Hazard Rating is defined in NFPA 704, Standard System for the Identification of the Fire Hazards of Materials. To aid in understanding this NFPA rating, the following summary is given:

| Rating No. | Comments |
|---|---|
| 4 | This degree includes flammable gases, pyrophoric liquids, and Class IA flammable liquids. |
| 3 | This degree includes Class IB and IC flammable liquids and materials that can be easily ignited under almost all normal conditions. |
| 2 | This degree includes materials that must be moderately heated before ignition will occur and includes Class II and IIIA combustible liquids and solids and semi-solids that readily give off ignitible vapors. |
| 1 | This degree includes materials that must be preheated before ignition will occur, such as Class IIIB combustible liquids and solids and semi-solids whose flash point exceeds 200° F. (93.4° C.), as well as most ordinary combustible materials. |
| 0 | This degree includes any material that will not burn. |

The second solvent used in the solvent systems of this invention is mostly n-propyl bromide. Since the production of n-propyl bromide can result in the co-production of minor amounts of other brominated propanes, especially isopropyl bromide, they may also be present in the second solvent depending upon the producers' efforts to effect their removal. The impurities that may be found are exemplified by propyl alcohol, propyl ether, propyl chloride, propylene, propane, butyl bromide, and the like. Generally, the crude n-propyl bromide product will be 99+ wt % brominated propane, 90 wt % being n-propyl and the remainder being about 10 to 0 wt % other brominated propanes and very minor amounts of impurities. Preferred processes produce a crude n-propyl bromide product containing at least 94–96 wt % n-propyl bromide and about 4–6 wt % isopropyl bromide and very minor amounts of other impurities, be they brominated compounds or not. Purified n-propyl bromide can contain 98 wt % n-propyl bromide and preferred, high purity n-propyl bromide can contain 99+ wt % n-propyl bromide with the remainder being isopropyl bromide and other impurities. Commercial grades of n-propyl bromide are acceptable for the purposes of this invention. All of the foregoing weight percents are based upon the total weight of the second solvent.

The impurities found in the second solvent are those which are the result of the production of n-propyl bromide and are generally present in amounts less than about 0.1 wt %.

The hydrocarbon solvent constituent of the solvent systems of this invention have a flash point, as determined by ASTM D-93, which is at or below about 38° C. (100° F.). It is not necessary, but it is convenient that this constituent have an atmospheric boiling point at sea-level which is within ±15° C. of the boiling point of the second solvent. Preferred are those hydrocarbon solvents which form constant boiling azeotropes with the second solvent. Both the hydrocarbon solvent and the second solvent should have good miscibility one with the other.

The hydrocarbon solvent constituent has at least some solvent quality in regards to organic materials such as fats, waxes, resins, greases, oils and the like, and is useful in metal degreasing and electronic and precision cleaning. Exemplary hydrocarbons are: terpenes, such as pinene, limonene, carene, and camphene; hexane; benzene; toluene; cyclohexane; and mixtures of any two or more of the foregoing. Others suitable hydrocarbon solvents are exemplified by those in the following classes which fulfill the flash point and solvency criteria for the hydrocarbon solvents of this invention. The classes are alkanes, alkenes, cycloalkanes, cycloalkenes, aromatics, and mixtures of any of the foregoing.

Additional benefit can be obtained by selecting the hydrocarbon solvent so that it has good solvency for those waxes, greases, oils, etc., which are not handled particularly well by the n-propyl bromide-based second solvent.

The mount of the second solvent used should contribute at least about 10 vol % of the total solvent system. Also, the amount of second solvent used should be sufficient to obtain no flash point for the solvent system when tested in accordance with ASTM D-93. Preferably, the solvent system will contain from about 35 to about 80 vol % second solvent. A most preferred solvent system contains from about 40 to about 65 vol % second solvent. All percentages by volume are based upon the total volume of the second solvent and the hydrocarbon solvent in the solvent system.

The amount of the hydrocarbon solvent used should be at least 10 vol % and complementary to the chosen amount of second solvent used.

The solvent systems of this invention may also need to be stabilized depending upon the anticipated temperature to which they will be exposed. Time of exposure is also a factor. Halogenated solvents are notorious for being corrosive to metals such as aluminum, magnesium and titanium. These metals appear to catalyze the dehydrohalogenation of the solvent, which dehydrohalogenation produces halogen acid which in turn attacks the metal, severely corroding it. It has been conventionally taught that brominated solvents, such as n-propyl bromide and isopropyl bromide, are corrosive to metals even at ambient temperatures and that they need to be stabilized with more than 0.1 wt % stabilizer. Typical stabilizers are nitroalkanes, ethers, epoxides and amines. See European Patent Application No. 0 609 004. It has been discovered that this conventional view is only partially correct. Isopropyl bromide is corrosive from ambient temperatures up to its boiling point. However, is has now been discovered that n-propyl bromide is not nearly as active. Corrosion of fresh aluminum by nearly pure n-propyl bromide does not occur until the temperature is above 60° C. and the exposure time is 24 hours. At ambient temperatures, little or no corrosion is seen. At higher temperatures, which go up to 70° C., less than about 0.1 wt % stabilizer is needed to attenuate the corrosive effect of n-propyl bromide. Preferred amounts of stabilizer range from about 0.05 to less than about 0.1 wt %. Most preferred are amounts within the range of from about 0.05 to about 0.09 wt %. (The wt % is based upon the total weight of stabilizer and n-propyl bromide.) When designing a solvent system of this invention for general use, it would be prudent to include the small amount of stabilizer mentioned above as the end-use temperature of the solvent system may exceed 60° C. If on the other hand, the practitioner knew that the end-use would not exceed 60° C. for 24 hours, then the solvent system would not require the use of a stabilizer for the n-propyl bromide.

The foregoing concerns the stabilization of the n-propyl component of the second solvent. As mentioned above, the isopropyl bromide, which can be as much as 10 wt % of the second solvent, is of a much more corrosive nature. Hence, the total amount of stabilizer used will not only have to stabilize the n-propyl bromide, if necessary, but also stabilize the isopropyl bromide. For each amount of n-propyl and isopropyl bromide in the second solvent, empirical determination as to the amount of stabilizer needed can be easily performed. Generally, if the second solvent contains less than about 1 wt % isopropyl bromide, the amount of stabilizer used can be less than about 0. 1 wt %. Experimental work has shown that 99+ wt % n-propyl bromide will not cause corrosion of fresh aluminum surfaces at 70° C. for 24 hours if stabilized with 0.09 wt % nitromethane, or 0.05 wt % nitromethane, or 0.09 wt % 1,2-epoxybutane, or a combination of 0.045 wt % nitromethane and 0.045 wt % 1,2-epoxybutane.

Any combination of the conventional stabilizers which are taught by the art to be useful in stabilizing halogenated hydrocarbon solvents are suitable. They may be used singularly or in combination.

The nitroalkanes useable in the present invention include nitromethane, nitroethane, 1-nitropropane, 2-nitropropane and nitrobenzene. They are usable either singularly or in form of a mixture of two or more of them.

The ethers include 1,2-dimethoxyethane, 1,4-dioxane, 1,3-dioxalane, diethyl ether, diisopropyl ether, dibutyl ether, trioxane, alkyl cellosolves in which the alkyl group has 1 to 10 carbon atoms such as methyl cellosolve, ethyl cellosolve and isopropyl cellosolve, acetal, acetone, dimethyl acetal, γ-butyrolactone, methyl t-butyl ether, tetrahydrofuran and N-methylpyrrole. They are usable either singularly or in the form of a mixture of two or more of them.

The epoxides include epichlorohydrin, propylene oxide, butylene oxide, cyclohexene oxide, glycidyl methyl ether, glycidyl methacrylate, pentene oxide, cyclopentene oxide and cyclohexene oxide. They are usable either singularly or in the form of a mixture of two or more of them.

The amines include hexylamine, octylamine, 2-ethylhexylamine, dodecylamine, ethylbutylamine, hexylmethylamine, butyloctylamine, dibutylamine, octadecylmethylamine, triethylamine, tributylamine, diethyloctylamine, tetradecyldimethylamine, diisolbutylamine, diisopropylamine, pentylamine, N-methylmorpholine, isopropylamine, cyclohexylamine, butylamine, isobutylamine, dipropylamine, 2,2,2,6-tetramethylpiperidine, N,N-di-allyl-p-phenylenediamine, diallyamine, aniline, ethylenediamine, propylenediamine, diethylenetriamine, tetraethylenepentamine, benzylamine, dibenzylamine, diphenylamine and diethylhodroxyamine. They are usable either singularly or in the form of a mixture of two or more of them.

The solvent systems of this invention are particularly useful in deterging metal products and electronic parts. The product or part can be dipped in the solvent system which is at a temperature below its boiling point. Also, the solvent systems of this invention can be used as a vapor to effect cleansing of the products or parts. In general, the solvent systems of this invention are suitable for use in all those applications which have been found suitable for chlorinated hydrocarbon solvents, e.g., 1,1,1-trichloroethane, trichloroethylene, perchloroethylene and the like. It is a particular benefit of the solvent systems of this invention that they function well in replacing chlorinated hydrocarbons without the adverse effect on the environment that is claimed for chlorinated hydrocarbons.

EXAMPLES

The following solvent systems were tested in accordance with ASTM D-93. The temperatures at which a flash point was obtained were noted. Also noted was when no flash point was detected. All volume percentages are base on the total volume of the solvent system tested.

| Example No. | Solvent System | Flash Temperature |
|---|---|---|
| | Comparative - Examples I–V | |
| I | 80 vol % hexane<br>10 vol % ethyl bromide<br>10 vol % bromochloromethane | −19° C. |
| II | 65 vol % hexane<br>17.5 vol % ethyl bromide<br>17.5 vol % bromochloromethane | −10° C. |
| III | 50 vol % hexane<br>25 vol % ethyl bromide<br>25 vol % bromochloromethane | *no flash pt. to 40° C. |
| IV | 50 vol % hexane<br>25 vol % n-propyl bromide<br>25 vol % bromochloromethane | −15° C. |
| V | 65 vol % hexane<br>17.5 vol % n-propyl bromide<br>17.5 vol % bromochloromethane | −26° C. |
| | Examples VI–VIII (of the invention) | |
| VI | 50 vol % hexane<br>50 vol % n-propyl bromide | no flash point |
| VII | 55 vol % hexane<br>45 vol % n-propyl bromide | no flash point |
| VIII | 65 vol % hexane<br>35 vol % n-propyl bromide | no flash point |

*Flash point measurement past this temperature was problematic because the solvent began to boil.

Note that ethyl bromide is reported in NFPA 325, previously cited, to have no flash point and to have a flammability rating of only 1. Bromochloromethane is well known in the art as a flame retardant.

We claim:

1. A solvent system comprised of:
   (a) a hydrocarbon solvent selected from the group consisting of alkanes, alkenes, cycloalkanes, cycloalkenes and (i) having a flash point which is below about 38° C., (ii) having a boiling point which is within ±15° C. of the boiling point of the second solvent in (b), and (iii) being present in an amount which is at least 10 vol % of the total solvent system; and
   (b) a second solvent which consists essentially of at least about 90 wt % n-propyl bromide and less than 10 to 0 wt % other brominated propane(s), based upon the total weight of the second solvent, the second solvent,
      (1) being present in an amount which is,
         (i) at least from about 35 to about 85 vol % of the total solvent system, and
         (ii) is sufficient to obtain no flash point for the solvent system when tested in accordance with ASTM D-93; and
      (2) being the sole halogenated solvent and halogenated flash point suppressor constituent in the solvent system.

2. The solvent system of claim 1 wherein the hydrocarbon solvent is hexane, a terpene or a mixture thereof.

3. The solvent system of claim 1 wherein the solvent system contains a stabilizer to attenuate metal corrosion by the second solvent.

4. The solvent system of claim 1 wherein the n-propyl bromide in the second solvent is stabilized against metal corrosion by the presence of from about 0.05 to less than about 0.1 wt % stabilizer, paid wt % being based upon the total weight of the n-propyl bromide and the n-propyl bromide stabilizer in the second solvent.

5. The solvent system of claim 1 wherein the second solvent consists essentially of at least about 94 wt % n-propyl bromide.

6. The solvent system of claim 1 wherein the second solvent consists essentially of at least about 99 wt % n-propyl bromide.

7. The solvent system of claim 6 wherein the n-propyl bromide in the second solvent is stabilized against metal corrosion by the presence of from about 0.05 to less than about 0.1 wt % stabilizer, said wt % being based upon the total weight of the n-propyl bromide and the n-propyl bromide stabilizer in the second solvent.

8. A solvent system comprised of:
   (a) a hydrocarbon solvent selected from the group consisting of alkanes, alkenes, cycloalkanes, cycloalkenes and (i) having a flash point which is below about 38° C., (ii) having a boiling point which is within ±5° C. of the boiling point of the second solvent in (b), and (iii) being present in an mount which is at least 10 vol % of the total solvent system;
   (b) a second solvent which consists essentially of at least about 90 wt % n-propyl bromide and less than 10 to 0 wt % other brominated propane(s), based upon the total weight of the second solvent, the second solvent,
      (1) being present in an amount which is,
         (i) at least about 10 vol % of the total solvent system, and
         (ii) is sufficient to obtain no flash point for the solvent system when tested in accordance with ASTM D-93; and
      (2) being the sole halogenated solvent and halogenated flash point suppressor constituent in the solvent system; and
   (c) from about 0.05 to about 0.1 wt % stabilizer, said stabilizer selected from the group consisting of nitroalkanes, ethers epoxides, amines and mixtures of two or more of the foregoing.

9. The solvent system of claim 8 wherein the second solvent consists essentially of at least about 94 wt % n-propyl bromide.

10. The solvent system of claim 8 wherein the second solvent consists essentially of at least about 99 wt % n-propyl bromide.

11. The solvent system of claim 8 wherein there is from about 35 to 85 vol % of the second solvent in the total solvent system.

12. The solvent system of claim 8 wherein there is from about 35 to 85 vol % of the second solvent in the total solvent system.

13. A solvent system consisting essentially of:
   (a) a hydrocarbon solvent selected from the group consisting of alkanes, alkenes, cycloalkanes, cycloalkenes and (i) having a flash point which is below about 38° C., (ii) having a boiling point which is within ±15° C. of the boiling point of the second solvent in (b), and (iii) being present in an amount which is at least 10 vol % of the total solvent system;

(b) a second solvent which consists essentially of at least about 90 wt % n-propyl bromide and less than 10 to 0 wt % other brominated propane(s), based upon the total weight of the second solvent, the second solvent, (1) being present in an amount which is, (i) at least about 10 vol % of the total solvent system, and (ii) is sufficient to obtain no flash point for the solvent system when tested in accordance with ASTM D-93; and (2) being the sole halogenated solvent and halogenated flash point suppressor constituent in the solvent system; and (c) a stabilizer selected from the group consisting of nitroalkanes, epoxides, amines and mixtures of one or more of the foregoing.

14. The solvent system of claim 13 wherein the second solvent consists essentially of at least about 94 wt % n-propyl bromide.

15. The solvent system of claim 13 wherein the second solvent consists essentially of at least about 99 wt % n-propyl bromide.

16. The solvent system of claim 13 wherein the n-propyl bromide in the second solvent is stabilized against metal corrosion by the presence of from about 0.05 to less that about 0.1 wt % stabilizer being based upon the total weight of the n-propyl bromide and the n-propyl bromide stabilizer in the second solvent.

* * * * *